US006760000B2

(12) United States Patent
Ide et al.

(10) Patent No.: US 6,760,000 B2
(45) Date of Patent: Jul. 6, 2004

(54) DRIVE CIRCUIT OF PLASMA DISPLAY PANEL UNIT

(75) Inventors: Shigeo Ide, Yamanashi-ken (JP); Kenichi Kobayashi, Yamanashi-ken (JP)

(73) Assignees: Pioneer Corporation, Tokyo (JP); Shizuoka Pioneer Corporation, Shizuoka-Ken (JP)

( * ) Notice: Subject to any disclaimer, the term of this patent is extended or adjusted under 35 U.S.C. 154(b) by 216 days.

(21) Appl. No.: 10/175,454

(22) Filed: Jun. 20, 2002

(65) Prior Publication Data

US 2003/0001803 A1 Jan. 2, 2003

(30) Foreign Application Priority Data

Jun. 29, 2001 (JP) ..... P2001-199364

(51) Int. Cl.[7] ..... G09G 3/28
(52) U.S. Cl. ..... 345/66
(58) Field of Search ..... 345/66, 60, 62, 345/204, 208, 211, 212; 315/169.1, 169.3

(56) References Cited

U.S. PATENT DOCUMENTS 5,936,598 A * 8/1999 Hayama et al. ..... 345/76
6,011,355 A * 1/2000 Nagai ..... 315/169.3
6,150,999 A * 11/2000 Chen et al. ..... 345/60
6,222,327 B1 * 4/2001 Shoji et al. ..... 315/291

* cited by examiner

*Primary Examiner*—Kent Chang
(74) *Attorney, Agent, or Firm*—Sughrue Mion, PLLC

(57) ABSTRACT

A drive circuit of plasma display panel (PDP) unit including at least a pair of electrodes and discharge cells connected thereto, further comprises a first path having a first switch and a first coil for applying voltage to the discharge cells; a second path having a second switch and a second coil for expelling the voltage applied to the discharge cells; and electric charge accumulating devices connected to the first path and the second path, wherein the inductance value of the second coil is larger than the inductance value of the first coil.

1 Claim, 5 Drawing Sheets

DRIVE CIRCUIT OF PLASMA DISPLAY PANEL UNIT

BACKGROUND OF THE INVENTION

1. Field of the Invention

The present invention relates to technology relating to matrix type plasma display panel (PDP) and more particularly to technology relating to plasma display panel whose drive power supply is automatically adjusted.

2. Description of the Related Art

Since before, it has been well known that reactive power can be decreased in sustain period because if the resonance frequency of the sustain circuit is reduced in a drive circuit of the PDP unit, a current peak value at the time of resonance is decreased, so that effective current is also decreased.

The sustain circuit mentioned here refers to a circuit for supplying electric power to a discharge cell in order to sustain discharge in a stable condition and the sustain period refers to a period in which light emission of the discharge cell is repeated by the sustain circuit so as to maintain the light emission condition.

Conventional technology about the driving circuit of the PDP unit has been disclosed in Japanese Patent Application Laid-Open No. 2000-293135.

However, if the resonance frequency of the sustain circuit is decreased, there is a trouble that it leads to changing discharge condition thereby affecting discharge margin and discharge intensity.

The above-mentioned Japanese Patent Application Laid-Open No. 2000-293135 does not describe any special matter about reduction of reactive power by operating the resonance frequency of the sustain circuit.

SUMMARY OF THE INVENTION

An object of the present invention is to provide a drive circuit of the PDP unit capable of operating the resonance frequency of the sustain circuit so as to reduce reactive power in a circuit in the sustain period without affecting discharge margin and discharge intensity.

A drive circuit of PDP unit including at least a pair of electrodes and discharge cells connected thereto, is further provided: a first path having a first switch and a first coil for applying voltage to the discharge cells; a second path having a second switch and a second coil for expelling the voltage applied to the discharge cells; and electric charge accumulating devices connected to the first path and the second path, wherein the inductance value of the second coil is larger than the inductance value of the first coil.

Consequently, according to the present invention, the resonance frequency at the time of fall, which does not affect discharge condition, can be reduced while maintaining a conventional resonance frequency at the time of leading, which affects the discharge condition. Thus, the peak value of current upon resonance can be reduced and effective current can be reduced, so that reactive power in a circuit in the sustain period can be reduced.

DESCRIPTION OF THE PREFERRED EMBODIMENTS

Hereinafter, an embodiment of a plasma display panel (PDP) unit of the present invention will be described with reference to the accompanied drawings.

Figure 1:
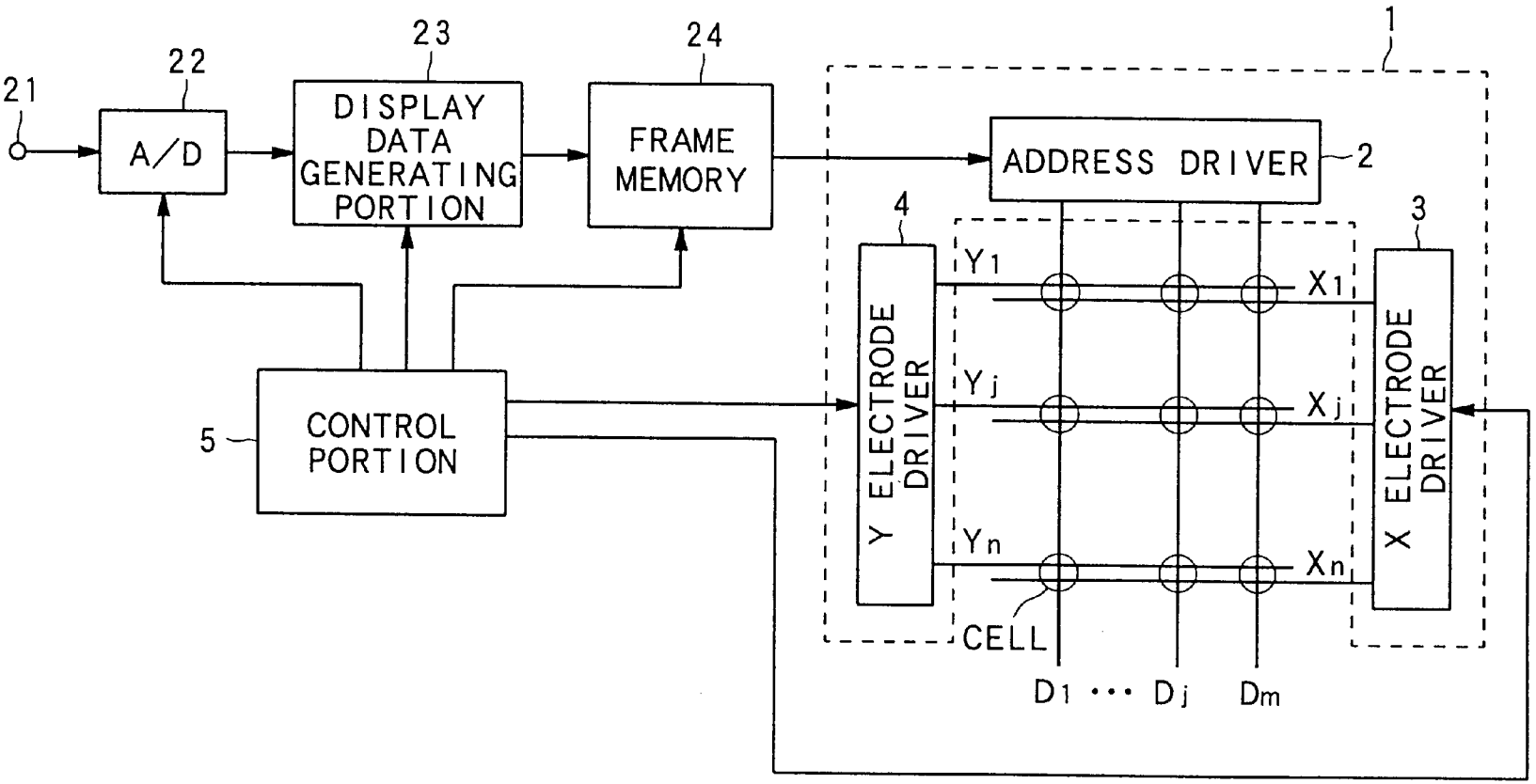
FIG. 1 is a block diagram showing an outline of the PDP unit according to an embodiment of the present invention.

FIG. 1 is a block diagram showing an outline of the PDP unit.

The PDP unit comprises an input terminal 21, an A/D converter 22, a display data generating portion 23, a frame memory 24, an address driver 2, a control portion 5, an X-electrode driver 3 and a Y-electrode driver 4.

A video signal inputted from the input terminal 21 is converted to digital video data by the A/D converter 22, processed to display data by the display data generating portion 23, and then supplied to the frame memory 24. The display data generating portion 23 computes emission time corresponding to the intensity of illumination of video data and corrects the data by reallocation so as to generate display data. The frame memory 24 is composed of, for example, a VRAM, which accumulates display data of a screen sent from the display data generating portion 23 and supplies it to the address driver 2 following synchronous signal from a control portion 5 which will be described later. The address driver 2 is composed of a driving circuit having a DC power supply and switching device, and generates pixel data pulse to each discharge cell on the display panel based on the display data inputted from a frame memory 24 and applies this to a column electrode Dj for every display line.

Figure 3:
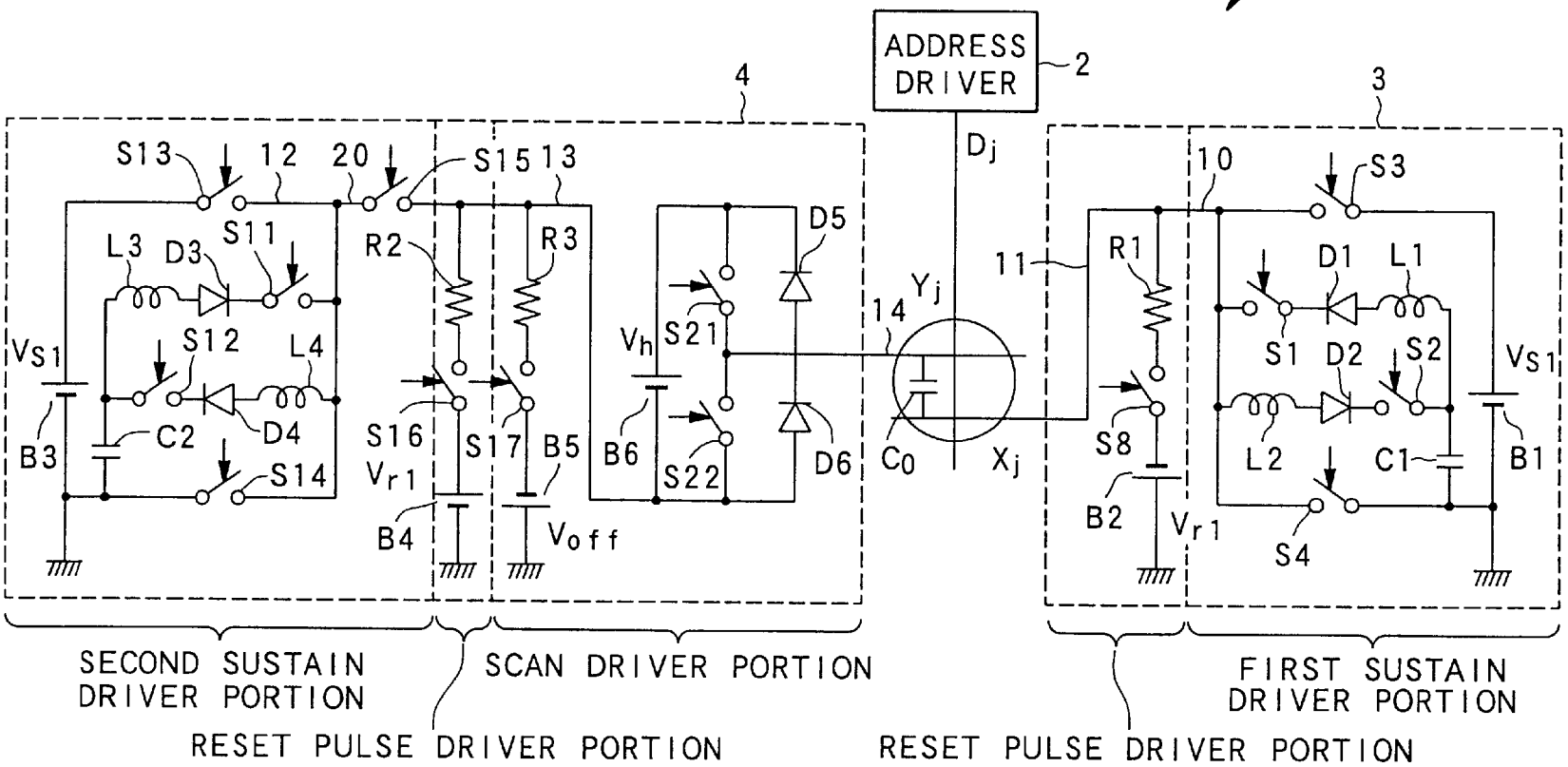
FIG. 3 is a conceptual diagram showing the structure of the PDP drive circuit according to an embodiment of the present invention.

The control portion 5 is constituted of, for example, CPU, which outputs a synchronous signal to the A/D converter 22, the display data generating portion 23 and the frame memory 24. The X-electrode driver 3 and the Y-electrode driver 4 are each constituted of a driving circuit having a DC power supply and switching devices as shown in FIG. 3. The X-electrode driver 3 applies sustain discharge pulse IPx to an electrode Xj and sustain discharge pulse IPy to an electrode Yj based on the synchronous signal from the control portion 5.

The operation of the PDP unit having such a structure will be described below.

A video signal inputted from the input terminal 21 as an analog signal is converted to digital video data by the A/D converter 22, processed to display data by the display data generating portion 23, and supplied to the frame memory 24. The frame memory 24 accumulates display data sent from the display data generating portion 23 and supplies it to the address driver 2 following synchronous signal from the control portion 5.

A synchronous signal is separated from the video signal inputted from the input terminal 21 by a sync separation circuit (not shown), and then the control portion 5 outputs the synchronous signal to the A/D converter 22, the display data generating portion 23 and the frame memory 24 on the basis of this separated synchronous signal. The control portion 5 drives the PDP by controlling ON/OFF of a switching device of the PDP driving circuit 1, which is a panel driving device shown in FIG. 3. Here, the PDP drive circuit 1 comprises the address driver 2, the X-electrode driver 3, and the Y-electrode driver 4.

Figure 2:
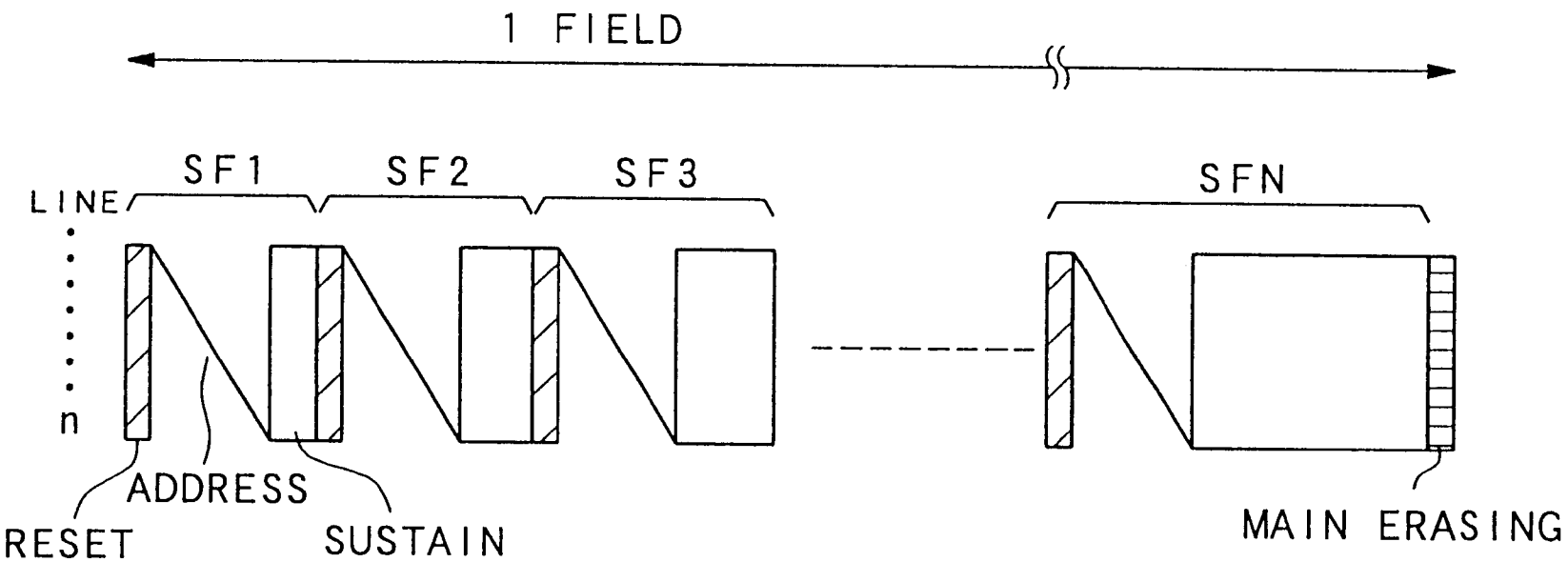
FIG. 2 is a schematic diagram showing drive sequence of the PDP according to an embodiment of the present invention.

The drive sequence of the PDP unit will be described with reference to FIG. 2.

A set of a sub-field (1 SF) has a reset period, an address period, and a sustain period. A set of a field, which is a drive sequence of the PDP, has several sub-fields, repeated N times, and thereafter a main erase process for resetting to a condition in which wall charge is erased by applying erase pulse respectively to all cells.

In the reset period, all the discharge cells of the PDP unit are gotten into luminous discharge cell condition. In the subsequent address period, the address driver 2 forms wall charge selectively to each discharge cell based on video signal so as to generate pixel data pulse which sets up luminous discharge cell or non-luminous discharge cell and apply this pulse to a column electrode of every display line. In the sustain period, sustain discharge pulse IPx and sustain discharge pulse IPy are generated alternately and applied to the column electrode X and column electrode Y alternately. As a result, in a luminous discharge cell in which the above-described wall charge remains, discharge light emission is repeated and then that light emission is sustained.

The drive circuit of the PDP unit of this embodiment reduces reactive power in the circuits of the X-electrode driver 3 and the Y-electrode driver 4 in the sustain period.

FIG. 3 is a conceptual diagram showing the structure of the PDP drive circuit 1 of this embodiment.

The PDP drive circuit 1, which works as a panel drive device, is comprised of the address driver 2, the X electrode driver 3, and the Y electrode driver 4. The X electrode driver 3 includes a reset pulse driver portion and a first sustain driver portion. The Y electrode driver 4 includes a reset pulse driver portion, a scan driver portion, and a second sustain driver portion.

The reset pulse driver portion applies a reset pulse respectively to all the column electrodes X1–Xn, Y1–Yn at the same time in the reset period. Consequently, all the discharge cells in the PDP unit are simultaneously discharged and excited to generate charged particles. After this discharge is stopped, a predetermined quantity of wall charges are accumulated on a dielectric layer of the discharge cells, so that luminous discharge cell condition is attained.

The scan driver portion applies a scan pulse SP to the electrode Yj in the address period so as to set the electrode Yj to a predetermined positive potential (Vh-Voff). This application is carried out synchronously with application of pixel data pulse DPj from the address driver 2. As a result, of the cells of the column electrode on which the scan pulse SP is applied, discharge occurs in only a cell onto which pixel data pulse of positive voltage is applied at the same time.

The first sustain driver portion and the second sustain driver portion generate sustain discharge pulse IPx and sustain discharge pulse IPy alternately in the sustain period and apply it to the column electrodes X1–Xn and the column electrodes Y1–Yn alternately. Consequently, discharge light emission is repeated in the light emission discharge cell in which the wall charge remains, and the light emission is sustained.

A first sustain driver portion of the X-electrode driver 3 contains a power supply B1, switching devices S1–S4, diodes D1, D2, coils L1, L2, and a capacitor C1, which works as a charge accumulating device. According to this embodiment, the inductance value of the coil L2 is larger than the inductance value of the coil L1.

A second sustain driver portion of the Y-electrode driver 4 contains a power supply B3, switching devices S11–S15, diodes D3, D4, coils L3, L4, and a capacitor C2, which works as a charge accumulating device. According to this embodiment, the inductance value of the coil L4 is larger than the inductance value of the coil L3.

The operation of the PDP drive circuit 1 having the above described structure will be described below.

The column electrode Xj is an electrode at the column j (one electrode composing the j display line) in the column electrodes X1–Xn and the column electrode Yj is an electrode at the column j (the other electrode composing the j display line) in the column electrodes Y1–Yn. The display panel cell is located between the column electrode Xj and Yj which form a pair and acts as a capacitor Co. The power supply B1 outputs a sustain voltage Vs1. The power supply B2 outputs a reset voltage Vr1.

The power supply B3 outputs a sustain voltage Vs1. The power supply B4 outputs a reset voltage Vr1. The power supply B5 generates a voltage Voff while the power supply B6 generates a scan pulse voltage Vh.

Figure 4:
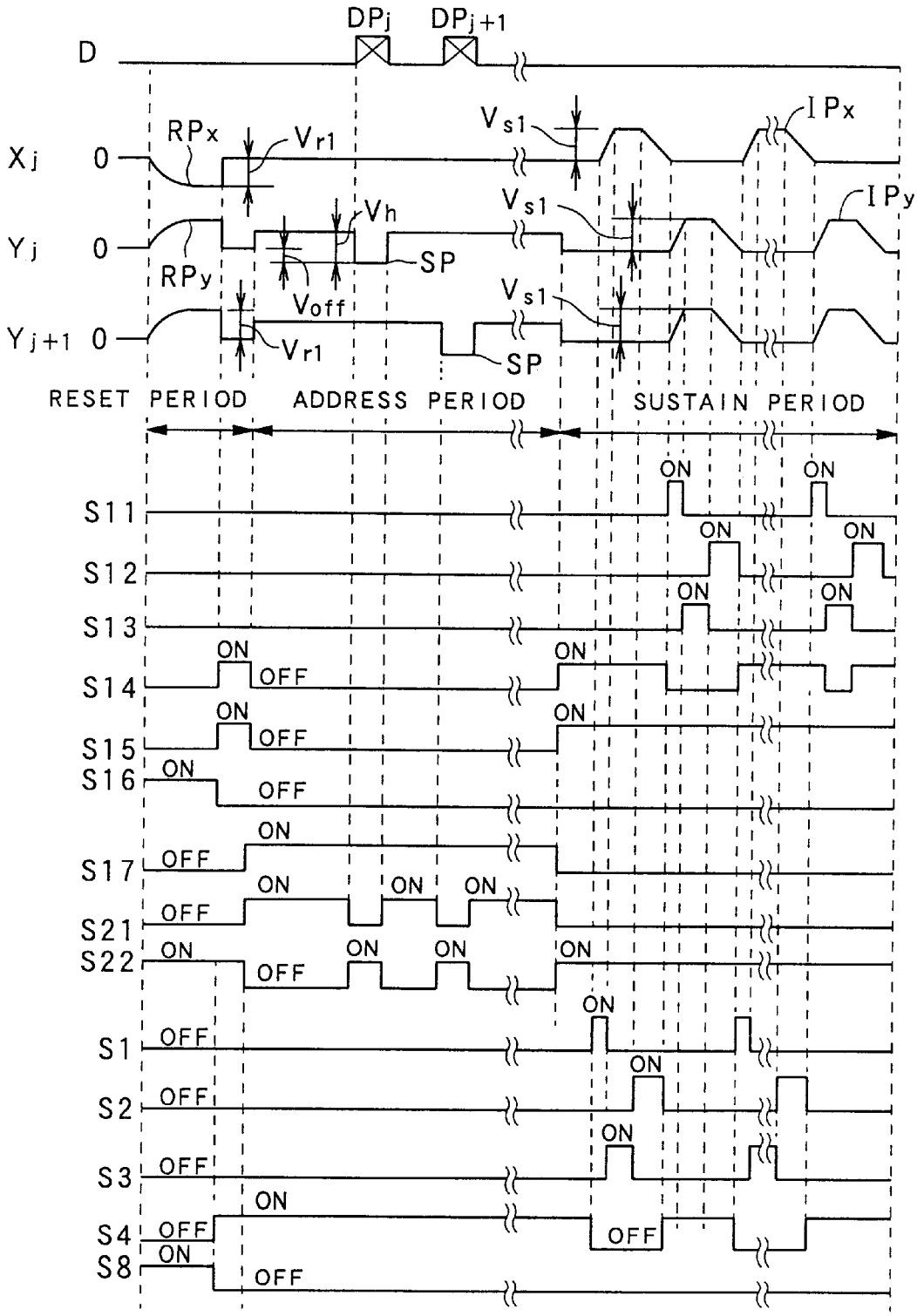
FIG. 4 is a conceptual diagram showing drive sequence of the PDP according to an embodiment of the present invention.

The operation of the PDP drive circuit 1 having such a structure will be described with reference to a time chart shown in FIG. 4. The drive sequence of this PDP describes the operation in a single sub-field. Subsequently, the reset period, address period, and sustain period will be described separately.

First, in the reset period, a switching device S8 of the X electrode driver 3 is turned ON, and at the same time, switching devices S16 and S22 of the Y electrode driver 4 are turned ON. The other switching devices are kept OFF. When the switching device S8 is turned ON, current flows from the electrode Xj to a negative terminal of the power supply B2 through a resistor R1 and a switching device S8. When the switching device S16 is turned ON, current flows into the electrode Yj from a positive terminal of a power supply B4 through a switching device S16, a resistor R1, and a switching device S22. The potential of the electrode Xj is decreased gradually depending upon time constant of a capacitor Co and the resistor R1 so that a reset pulse RPx is generated. The potential of the electrode Yj is increased gradually depending on time constant of the capacitor Co and the resistor R1 so that a reset pulse RPy is generated. Then, the potential of the reset pulse RPx is saturated to the voltage level −Vr1, and the potential of the reset pulse RPy is saturated to the voltage level Vr1. This reset pulse RPx is applied to all the column electrodes X1–Xn at the same time and the reset pulse RPy is applied to all the column electrodes Y1–Yn simultaneously.

When these reset pulses RPx, RPy are applied at the same time, all discharge cells of the PDP are discharged and excited at the same time so as to generate charged particles. After this discharge is stopped, a predetermined quantity of wall charge is accumulated on dielectric layers of all discharge cells, so that luminous discharge cell condition is attained. When the reset pulses RPx and RPy are saturated after a predetermined time interval elapses, the switching device S8 and the switching device S16 are turned OFF before the reset period is terminated. At the same time, the switching devices S4, S14 and S15 are turned ON and the electrodes Xj, Yj are grounded. The reset period is terminated.

Next, in the address period, the address driver 2 forms wall charge selectively to each discharge cell based on display data outputted by the display data generating portion 23, pixel data pulses DP1–DPm generate and the pulses set the cells the luminous discharge cells or non-luminous discharge cells. This process is applied to the column electrodes D1–Dm for every display line. Pixel data pulses DPj, DPj+1 are applied to the electrodes Yj, Yj+1. When the address period is started, the switching devices S14 and S15 are turned OFF, and the switching devices S17 and S21 are turned ON, and simultaneously the switching device S22 is turned OFF. If the switching devices S17 and S21 are turned ON, positive potential (Vh-Voff) is applied to the electrode Yj.

The switching device S21 is turned OFF synchronously with application of the pixel data pulse DPj from the address driver 2 and then switching device S22 is turned ON. Consequently, a negative potential indicating the voltage −Voff at a negative terminal of the power supply B5 is applied to as a scan pulse SP the electrode Yj through the switching device S22. Then, the switching device S21 is turned ON synchronously with termination of the pixel data pulse DPj from the address driver 2, and the switching device S22 is turned OFF, so that a predetermined positive potential (Vh-Voff) is applied to the electrode Yj. After that, the scan pulse SP is applied to the electrode Yj+1 also synchronously with application of the pixel data pulse DPj+1 from the address driver 2 like the case of the electrode Yj.

In the discharge cell belonging to the column electrode onto which the scan pulse SP is applied, discharge occurs only in a discharge cell onto which pixel data pulse of positive voltage is applied at the same time, so that wall charge of the cell erases. On the other hand, no discharge occurs in a discharge cell on which pixel data pulse of positive voltage is not applied at the same time although the scan pulse is applied and therefore, wall charge of the cell remains. In this case, the discharge cell in which the wall charge remains turns to a luminous discharge cell, while a discharge cell in which the wall charge is erased turns to a non-luminous discharge cell. When the address period is switched over to the sustain period, the switching devices S17 and S21 are turned OFF and at the same time, the switching devices S14, S15 and S22 are turned ON. The switching device S4 is kept ON.

Finally, the sustain period begins, the switching device S4 is turned OFF while the switching device S1 is turned ON. Consequently, current, whose origin is an electric charge accumulated in the capacitor C1, flows to the electrode Xj through a coil L1, a diode D1, and the switching device S1 to charge the capacitor Co. At this time, the potential of the electrode Xj is raised gradually depending on time constant of the coil L1 and capacitor Co. When half cycle of resonance cycle by the coil L1 and capacitor Co elapses, the switching device S1 is turned OFF while the switching device S3 is turned ON. Consequently, the potential of the electrode Xj becomes an equal to the sustain voltage Vs1 of the power supply B1.

Here, the half cycle (leading period) Tax of resonance cycle by the coil L1 and capacitor Co is expressed in a following expression.

[Expression 1]

$$Tax=\pi\times(L1\times Co)^{1/2}$$

If after a predetermined time elapses, the switching device S3 is turned OFF and the switching device S2 is turned ON, current flows to the capacitor C1 through the coil L2, the diode D2, and the switching device S2 based on electric charge accumulated in the capacitor Co, so that the capacitor C1 is charged. At this moment, the potential of the electrode Xj drops gradually depending upon time constant of each of the coil L2 and the capacitor Co. When the half cycle (falling period) of resonance cycle by the coil L2 and capacitor Co elapses (when the potential of the electrode Xj reaches 0 V), the switching device S2 is turned OFF while the switching device S4 is turned ON.

Here, the half cycle (falling period) Tbx of the resonance cycle by the coil L2 and the capacitor Co is expressed in a following expression.

[Expression 2]

$$Tbx=\pi\times(L2\times Co)^{1/2}$$

Because the inductance value of the coil L2 is larger than the inductance value of the coil L1 as described above, it comes that Tax<Tbx.

By such operation, the X electrode driver 3 applies sustain discharge pulse IPx to the electrode Xj. At the same time when the switching device S4 for erasing the sustain discharge pulse IPx is turned ON, the Y electrode driver 4 turns ON the switching device S11 and turns OFF the switching device S14. When the switching device S14 is turned ON, the potential of the electrode Yj is at grounding potential of OV. When the switching device S11 is turned ON while the switching device S14 is turned OFF, current flows to the electrode Yj through a coil L3, a diode D3, the switching device S11, a switching device S15 and a diode D6 based on electric charge accumulated on the capacitor C2 so that the capacitor Co is charged. At this time, the potential at the electrode Yj rises gradually depending upon time constant of the coil L3 and the capacitor Co.

When the half cycle (leading period) Tay of the resonance cycle by the coil L3 and the capacitor Co elapses, the switching device S11 is turned OFF while the switching device S13 is turned ON. Consequently, the potential of the electrode Yj becomes equal to the sustain voltage Vs1 of the power supply B3.

Here, the half cycle (leading period) Tay of resonance cycle by the coil L3 and capacitor Co is expressed in a following expression.

[Expression 3]

$$Tay=\pi\times(L3\times Co)^{1/2}$$

If after a predetermined time elapses, the switching device S13 is turned OFF and the switching device S12 is turned ON, current flows to the capacitor C2 through the switching device S22, the switching device S15, the coil L4, the diode D4, and the switching device S12 based on electric charge accumulated in the capacitor Co, so that the capacitor C2 is charged.

At this time, the potential of the electrode Yj drops gradually depending upon time constant of the coil L4 and capacitor Co. When the half cycle of resonance cycle by the coil L4 and the capacitor Co elapses (when the potential of the electrode Yj reaches 0V), the switching device S12 is turned OFF while the switching device S14 is turned ON.

Here, the half cycle (falling period) Tby of resonance cycle by the coil L4 and capacitor Co is expressed in a following expression.

[Expression 4]

$$Tby=\pi\times(L4\times Co)^{1/2}$$

Because the inductance value of the coil L4 is larger than the inductance value of the coil L3 as described above, it comes that Tay<Tby.

By such operation, the Y electrode driver 4 applies sustain discharge pulse IPy of positive voltage to the electrode Yj. In the sustain period, the sustain discharge pulse IPx and the sustain discharge pulse IPy are generated alternately and applied to the column electrode X1–Xn and the column electrodes Y1–Yn alternately. As a result, the luminous discharge cell in which the wall charge remains repeats discharge light emission so as to sustain its light emission.

Next, the relation between the sustain voltage and sustain current in the leading period and the falling period will be described with reference to FIG. 5.

Figure 5:
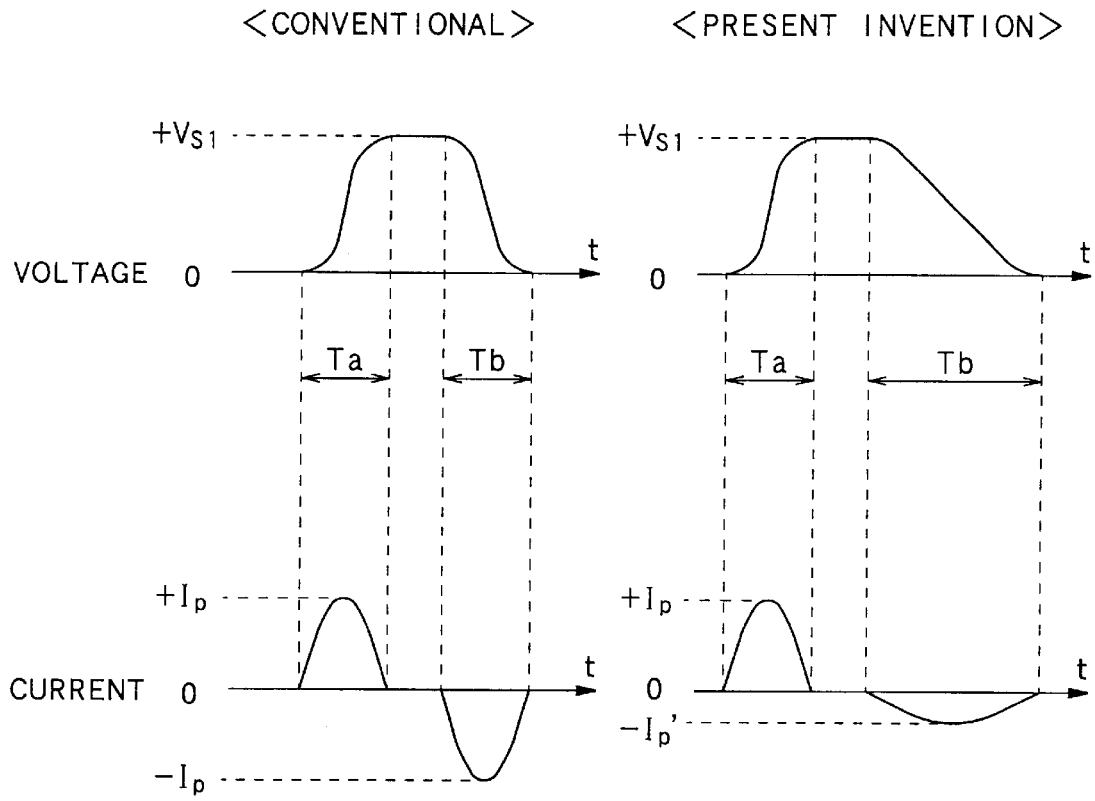
FIG. 5 is a schematic diagram showing the relation between sustain voltage and sustain current in leading period and falling period.

FIG. 5 is a schematic diagram showing the relation between the sustain voltage and sustain current in the leading period and the falling period.

Its left side shows the conventional relation between the sustain voltage and sustain current, while its right side shows the relation of the present invention between the sustain voltage and the sustain current. Further, its upper side indicates changes in the sustain voltage while its lower side indicates changes in the corresponding sustain current.

If the leading period Ta is equal to the falling period Tb like the conventional drive circuit, a period from the start of the leading to the end of the falling becomes shorter. However, the absolute values at the peak of the sustain current in the leading period and the falling period are equal high values.

Conversely, if the falling period Tb is longer than the leading period Ta like the present invention, the period from the start of the leading to the end of the falling becomes longer. However, the absolute value at the peak of the sustain current in the falling period is lower than that in the leading period. Consequently, effective current upon resonance becomes smaller, so that reactive power in a circuit in the sustain period can be reduced.

According to the present invention, the resonance frequency in the falling period Tb, which does not affect discharge condition, can be reduced while maintaining the resonance frequency of the leading period Ta which affects discharge condition under the same condition as conventionally. Thus, the peak value of current in the falling period Tb can be reduced so as to reduce the effective current. Therefore, reactive power in the circuit in the sustain period can be reduced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-199364 filed on Jun. 29, 2001 including the specification, claims, drawings and summary is incorporated herein by reference in its entirety.

What is claimed is:

1. A drive circuit of plasma display panel (PDP) unit including at least a pair of electrodes and discharge cells connected thereto, said drive circuit further comprising:

a first path having a first switch and a first coil for applying voltage to said discharge cells;

a second path having a second switch and a second coil for expelling the voltage applied to said discharge cells; and electric charge accumulating devices connected to said first path and said second path, wherein the inductance value of said second coil is larger than the inductance value of said first coil.

* * * * *

UNITED STATES PATENT AND TRADEMARK OFFICE

CERTIFICATE OF CORRECTION

PATENT NO. : 6,760,000 B2 
APPLICATION NO. : 10/175454
DATED : July 6, 2004
INVENTOR(S) : Shigeo Ide and Kenichi Kobayashi It is certified that error appears in the above-identified patent and that said Letters Patent is hereby corrected as shown below:

Under Assignee:

Please delete: ~~Pioneer Corporation, Tokyo (JP); Shizuoka Pioneer Corporation, Shizuoka Ken (JP)~~; and insert: Pioneer Corporation, Tokyo (JP); Pioneer Display Products Corporation, Shizuoka-Ken, (JP)

Signed and Sealed this

Twenty-seventh Day of February, 2007

JON W. DUDAS
*Director of the United States Patent and Trademark Office*